United States Patent [19]

Filice et al.

[11] 4,272,093

[45] Jun. 9, 1981

[54] SELF-PROPELLED ROLLING TOY

[76] Inventors: Dennis Filice, 7381 Doc Adams Rd., Marysville, Calif. 95901; David G. Bories, 8421 Ascolano Ave., Fair Oaks, Calif. 95628

[21] Appl. No.: 76,322

[22] Filed: Sep. 17, 1979

[51] Int. Cl.[3] ..... A63G 1/12; A63G 29/00

[52] U.S. Cl. ..... 280/206; 104/68; 105/330; 272/35; 272/115

[58] Field of Search ..... 280/206, 207, 78, 205; 272/1 R, 1 B, 115, 35, 28; 104/68, 59, 53; 297/DIG. 3; 105/330

[56] References Cited

U.S. PATENT DOCUMENTS

| | | | |
|---|---|---|---|
| 3,013,806 | 12/1961 | Boyd | 280/207 |
| 3,066,951 | 12/1962 | Gray | 280/206 |
| 3,156,486 | 11/1964 | Fenwick | 280/206 |
| 3,252,711 | 5/1966 | Young | 280/78 |
| 3,712,674 | 1/1973 | Ando | 297/DIG. 3 |
| 3,769,929 | 11/1973 | Scheber | 272/1 B |
| 3,806,156 | 4/1974 | Tidwell | 272/115 X |

FOREIGN PATENT DOCUMENTS

| | | | |
|---|---|---|---|
| 132533 | 7/1901 | Fed. Rep. of Germany | 104/68 |
| 158904 | 3/1904 | Fed. Rep. of Germany | 104/68 |

*Primary Examiner*—John A. Pekar
*Attorney, Agent, or Firm*—Mark C. Jacobs

[57] ABSTRACT

A self-propelled rolling toy adapted to contain a child therein and rollable from one point to another, the toy including a seat, and a restraint for holding the child in fixed position in the toy while the child controls movement of the toy. Optionally, a ring is provided having a curved wall whereby, when the toy engages a first part thereof, it is automatically rolled back towards a second part thereof.

10 Claims, 13 Drawing Figures

SELF-PROPELLED ROLLING TOY

BACKGROUND OF THE INVENTION

1. Field of the Invention

The invention relates to toys; and, more particularly, to a self-propelled recreational rolling toy vehicle particularly suitable for use by a child.

2. Description of the Prior Art

Recreational toys of all types have had continuing popularity over the years. Various kinds of rolling self-propelled toys have been proposed over the years but such have been found to be generally unsatisfactory. For example, in U.S. Pat. No. 3,905,617 to Smith, one such toy is described. However, in the Smith device, the child is tumbled freely therein which can greatly frighten a young child. There is also no restraint to travel of the toy. A similar device is disclosed in U.S. Pat. No. 3,674,260 but such is merely meant to be rocked along a surface. In U.S. Pat. No. 3,066,951 to Gray, a freely rotatable ball is shown which does not have a seat for the user and does not move in a confined area. In U.S. Pat. No. 3,477,713 to Cudmore, a rocking capsule is disclosed but such is irregularly shaped and therefore does not roll evenly. Further, the child is tossed freely about and is not kept in a confined, predetermined path.

There is thus a need for a rolling toy which is comfortable, inexpensive and confines the child and restraints his or her movement during rolling thereof.

SUMMARY OF THE INVENTION

It is an object of this invention to provide an improved self-propelled rolling toy.

It is a further object of this invention to provide a self-propelled rolling toy having a seat and a restraint for a child so that the child's movements are controlled during rolling.

It is still another object of this invention to provide a self-propelled rolling toy having confined movement.

These and other objects are preferably accomplished by providing a toy having a seat, and a restraint for holding the child in fixed position in the toy while the child's movements control the travel of the toy. Optionally, a ring is provided having a curved wall whereby, when the toy engages a first part thereof, it is automatically rolled back towards a second part thereof.

DESCRIPTION OF THE PREFERRED EMBODIMENT

Figure 1:
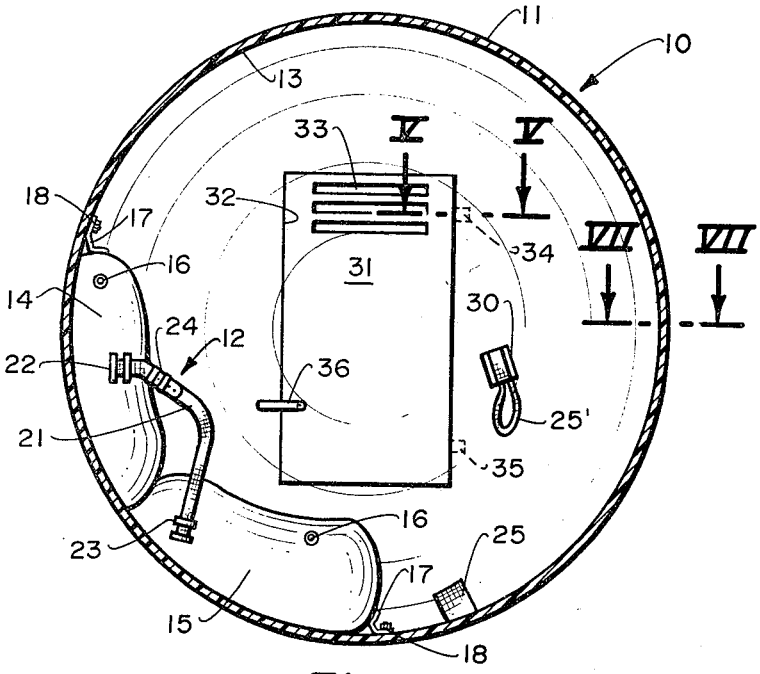
FIG. 1 is a vertical, partly sectional, view of a toy in accordance with the invention.

Referring now to FIG. 1 of the drawing, toy 10 is shown comprised of a generally spherical housing 11 which is preferably of a rigid material, such as plastic or stiff rubber or the like. As seen, a seat 12 is provided along one curved portion of the inner wall 13 of housing 11. Seat 12 may be molded or otherwise integral with wall 13. Also, seat 12 may be removable from the interior of housing 11.

Preferably, as shown, seat 12 is comprised of two sections, an upper torso or upper back seat section 14 and a lower seat cushion section 15. Each section 14,15 may be of an inflatable resilient material, such as rubber or any of the various plastics, such as vinyl, and each section 14,15 includes an air valve 16 for selectively inflating and deflating the same.

Figure 2:
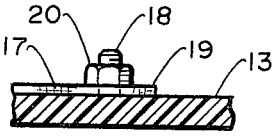
FIG. 2 is a detailed view of a portion of the toy of FIG. 1.

Each section 15 includes an integral strap 17. As particularly shown in FIG. 2, threaded posts 18 may be molded or otherwise formed on the inner wall 13 with apertured end 19 of each strap 17 fitting over the post 18 and nut 20 threaded thereon to secure strap 17 to post 18 and thus to housing 11. Of course, any suitable fastening means may be used. For example, instead of posts 18 being molded in the wall 13, apertures may be provided in wall 13 for receiving suitable nuts and bolts as is well known in the art.

Referring again to FIG. 1, restraint means is provided in the form of a seat harness 21 which may be secured at the top and bottom to both sides of each section 14,15, as shown at slotted loops 22,23 (the loops on the opposite side not being visible) and made of suitable flexible material such as nylon webbing. Of course, belt 21 may be attached to wall 13 by any suitable means, as discussed below with respect to FIG. 4. The harness 21 may be adjustable via clasp 24 to accommodate children of different sizes and be easily and quickly detachable from the child, as is well known in the seat belt art.

A foot strap 25 is provided below section 15 comprised of a looped flexible material, such as nylon webbing, for insertion of one of the feet of the child (a second such strap—not visible—may also be provided for the other foot). Strap 25 may be adjustable, if desired, and secured to inner wall 13 in any suitable manner.

Figure 4:
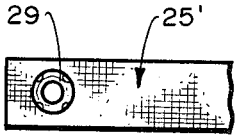
FIG. 4 is a detailed view of a portion of the toy of FIG. 1.
Figure 3:
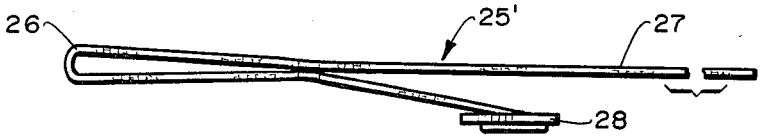
FIG. 3 is a detailed view of a another portion of the toy of FIG. 1.

One or more hand straps 25' may also be provided on the inner wall 13 at any convenient location and, as shown in FIG. 3, each hand strap 25' includes a loop 26, the end 27 being insertable into and through buckle 28 to vary the length thereof. Of course, any suitable means may be used to attach hand straps 25' to inner wall 13. Straps 25' may be insertable into slots 30 in FIG. 1. Also, as shown in FIG. 4, metal grommets 29 may be provided on strap 25' to snap-fit into suitable snaps (not shown) provided on inner wall 13 in lieu of slots 30. The same arrangement of grommets and snaps may of course be used for all of the harnesses and straps heretofore and hereinafter described.

Figure 5:
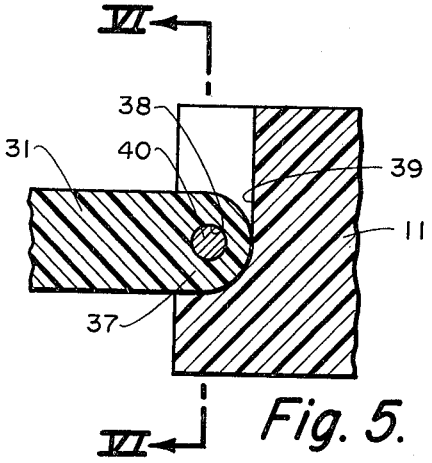
FIG. 5 is a top plan view of a portion of the toy of FIG. 1 taken along lines V—V thereof.
Figure 6:
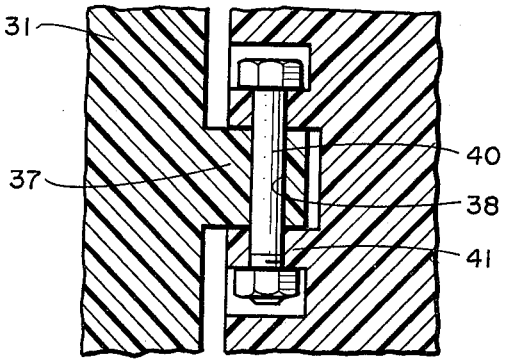
FIG. 6 is a view taken along lines VI—VI of FIG. 5.
Figure 11:
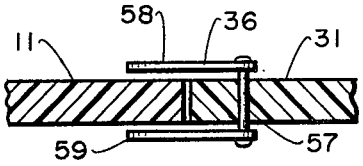
FIG. 11 is a view taken along lines XI—XI of FIG. 1.
Figure 12:
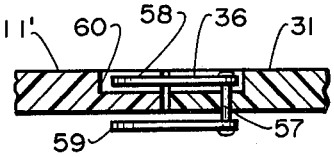
FIG. 12 is a view similar to FIG. 11 showing a modification thereof.

A door 31 may be optionally provided on toy 10 to enclose opening 32. Of course, opening 32 may be left doorless, if desired, but, if provided, should preferably include suitable air vents 33 (or air holes) for aeration. The vent or vents 33 may be screened, if desired, and the door 31 may be hingedly connected to housing 11 by one or more spaced hinges 34,35 and selectively opened and closed by handle 36. Handle 36 may also be of any suitable type, such as a pivotally mounted handle having a handle portion on both sides of door 31 with a lock portion, if desired, moving into a suitable jamb associated with door 31. Door 31 may be molded of the same material as housing 11. The hinges 34,35 may be of any suitable type, as, for example, shown in FIGS. 5 and 6 wherein door 31 includes a tab 37 having an aperture 38 fitting into a socket 39 in door 31 with a nut and bolt 40 passing through both tab 37 and wall portion 41 of housing 11 to hingedly secure the door 31 thereto. Handle 36 is shown in FIG. 11 and may include a pin 57 pivotally mounted in door 31 with handle portions 58,59 on each side of the door 31. This prevents door 31 from moving in and out. Although door 31 is shown as flush with body portion 11 in FIG. 11, as shown in FIG. 12, a recess 60 may be provided on the outside of door 31 and body portion 11 so that handle portion 58 does not protrude when the toy is rolling thus impeding movement. Handle 36 is thus operable from either the interior or exterior, as discussed, and may be sliding or pivoting, all as is well known in the art.

Figure 7:
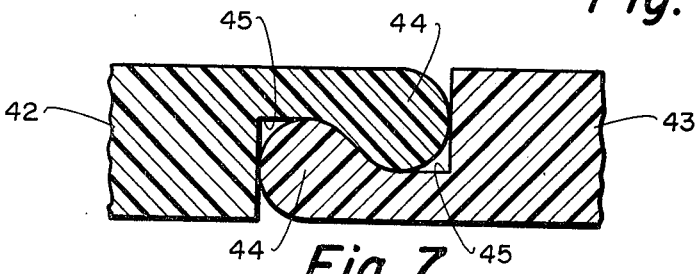
FIG. 7 is a view taken along lines VII—VII of FIG. 1.

Referring to FIG. 7, although housing 11 may be of a single molded unitary piece, preferably it is comprised of two hemispherical sections 42,43 as shown, wherein each section 42,43 includes a rounded tab 44 adapted to snap-fit in grooves 45. The two hemispherical sections 42,43 may be locked together with pressure required to push the tabs 44 apart to separate the sections 42,43.

Figure 8:
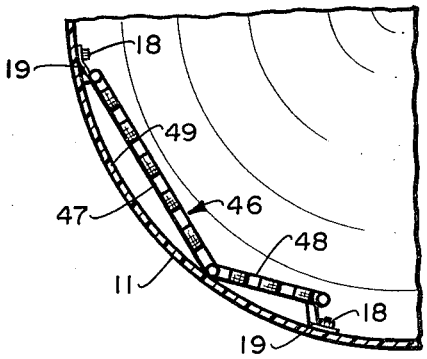
FIG. 8 is a vertical view of an alternate embodiment of the toy of FIG. 1.

Although an inflatable seat 12 has been disclosed, as shown in FIG. 8, seat 46 may be substituted comprised of a conventional tubular-type aluminum chair having a back portion 47 pivotally connected to a seat portion 48. Straps 49,50 are connected at one end to seat portion 48 and at the other end to suitable connectors, such as post 18 and connecting means 19, as previously described. Alternately, vinyl covered foam may be provided, or solid elastomeric plastic, for the seat, if desired.

Figure 10:
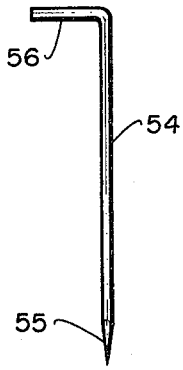
FIG. 10 is a detailed view of a portion of the arrangement of FIG. 9.
Figure 9:
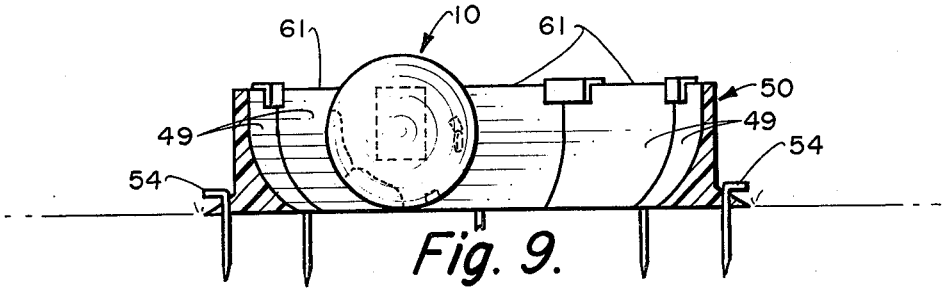
FIG. 9 is a vertical view of the toy of FIG. 1 disposed within a confined area.

In operation, a child opens door 31 via handle 36 and enters toy 10 (or enters opening 32 if door 31 is not used) and locks door 31 from the inside, as discussed. The child inflates sections 14,15 and straps himself in with harness 21, adjusting the same as necessary. The child hooks his feet in straps 25, grasps hand straps 25' and rocks toy 10 until it starts to roll. The child uses body english to control movement of toy 10. Thus, locomotion of toy 10 is provided by having the child shift the toy's center of gravity by partially standing up or leaning over. The harness 17 may have sufficient slack to accomplish this. Although toy 10 can be freely rolled along any terrain, optionally a confined area of movement may be provided. This is accomplished as shown in FIG. 9 by providing a ring 50 having a curved wall 49. Wall 49 includes a main as well as a curved wall portion, which may be of a suitable plastic and of a curvature related to that of toy 10, the overall height of wall 49 preferably being about two-thirds to one the radius height of toy 10. A resilient bumper rail, such as rubber, is provided at the top of wall 49. A plurality of apertured ears or tabs are provided on the outside portion of wall 49. A spike 54, (see FIG. 10), having a pointed end 55 and a short leg portion 56 extending normal to end 55, is provided. Leg portion 56 is inserted into one of the ears or tabs and the pointed end 55 is inserted into the ground to thereby support curved wall 49. It can be appreciated that, by inserting portion 56 into one of the other ears 53, the degree of curvature of wall 49 is varied.

By placing curved wall 49, as shown in FIG. 9, toy 10 can be rolled up on the curved wall portion, permitting the toy 10 to roll back toward the other parts of the curved wall portion. In this manner, the toy 10 can be confined within a predetermined area, if desired. This is preferable for small children and defines a secure area of play.

Although toy 10 is preferably used outdoors, it can be used indoors if desired. In place of spike 54, supports having weighted ends may be substituted.

Although seat 12 has been described as being provided on the inner wall 13, it may be centrally located, if desired, as by molding a seat in the middle of toy 10. Door 31 is of course optional and may be of transparent material so that the child may look out during play. Obviously, the location of the hand straps and foot straps may vary. Although any suitable materials may be used, a strong durable plastic, which may be brightly colored, is preferred. The various straps may be of nylon webbing.

Figure 13:
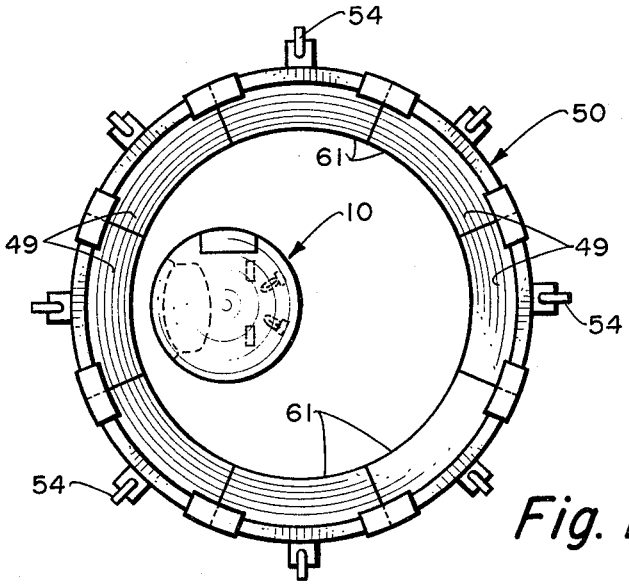
FIG. 13 is a top plan view of a playing area utilizing the toy of FIG. 1.

Ring 50 is preferably at least three times the diameter of housing 11. Also, although a generally circular ring 50 has been disclosed which a child can easily climb over, various configurations may be used, e.g. oval, rectangular, etc. The curvature of wall 49 is such that toy 10 is prevented from going over the top and out of the confined play zone. As shown in FIG. 13, ring 50 may be made up of a plurality of interconnected sections 61 that can snap together in any suitable manner. Although a circular arrangement is shown in FIG. 13, obviously any suitable configuration, such as oval, or any suitable size, may be used.

It can be seen that we have described a rolling toy that is self-propelled and capable of being confined within a predetermined area. Although the toy has been disclosed for use by a child, obviously the toy can be of any suitable size and usable by anyone who fits into the interior thereof.

We claim:

1. A rolling toy comprising:

a generally spherically shaped hollow shell structure having an interior sufficiently large to accomodate a human being;

an opening leading into the interior of said shell of a size sufficient to allow a human being to pass therethrough;

a seat disposed in the interior of said shell for providing a seat for a human being;

restraining means associated with said seat and said shell for both holding a human being in said seat and restraining movement thereof;

feet retaining means on the interior of said shell for retaining the feet of a human being in a fixed position; and hand gripping means on the interior of said shell for gripping by the hands of a human being wherein said seat is disposed against and integral with the inside wall of said hollow shell structure, and which seat is comprised of two sections, an upper back section and a lower seat cushion section, each of which is separately inflatable, said seat further including a pair of harnesses, one on the left and one on the right side therof, through which an occupant's left and right arms may be respectively inserted.

2. In the toy of claim 1 wherein said harnesses are each attached to the upper section and lower section of the seat.

3. In the toy of claim 1 wherein said harnesses each include an adjustable belt.

4. In the toy of claim 1 wherein said feet retaining means includes an adjustable foot strap.

5. In the toy of claim 1 wherein said hand gripping means includes a looped resilient strap adjustably coupled to the interior of said shell.

6. In the toy of claim 1 wherein said opening is closed off by a door hingedly connected to said shell.

7. In the toy of claim 6 wherein said door is vented and lockable to said shell.

8. In the toy of claim 1 wherein said shell is comprised of at least a pair of interconnected hemispherically shaped members.

9. In the toy of claim 1 including a confining area encircling said shell, said confining area having a single continuous curved wall curving from a point inwardly of said area upwardly and outwardly of the interior of said area whereby said shell can travel omnidirectionally within said confined area.

10. In the toy of claim 9 wherein said confining area is an annular ring supported on a supporting surface, and further wherein the curvature and height of said wall are correlated to the curvature and diameter of said shell whereby said shell is confined within said confining area and thereby prevented from going over the wall during said omnidirectional travel.

* * * * *